US005256216A

United States Patent [19]

Bunel et al.

[11] Patent Number: 5,256,216

[45] Date of Patent: Oct. 26, 1993

[54] CONTROLLED RESISTIVE HEAT TREATMENT FOR A CONTINUOUSLY MOVING ZIRCALOY SHEET

[75] Inventors: Gerard Bunel, Rugles; Charles Chauvel-Trepier, L'Aigle; Jean-Pierre Gros; Daniel Charquet, both of Albertville, all of France

[73] Assignee: Compagnie Europeenne Du Zirconium Cezus, Courbevoie, France

[21] Appl. No.: 836,835

[22] Filed: Feb. 19, 1992

[30] Foreign Application Priority Data

Feb. 22, 1991 [FR] France ..... 91 023777

[51] Int. Cl.[5] ..... C22C 16/00

[52] U.S. Cl. ..... 148/566; 148/672

[58] Field of Search ..... 148/566, 672

[56] References Cited

U.S. PATENT DOCUMENTS

| | | | |
|---|---|---|---|
| 2,441,500 | 4/1948 | Miess | 219/11 |
| 2,836,527 | 5/1958 | Kessler et al. | 148/566 |
| 3,394,036 | 7/1968 | Parris | 148/11.5 |
| 4,081,296 | 3/1978 | Janatka et al. | 148/16 |
| 4,689,091 | 8/1987 | Yoshida et al. | 148/672 |
| 4,717,428 | 1/1988 | Comstock et al. | 148/672 |
| 4,775,428 | 10/1988 | Bunel et al. | 420/422 |
| 4,938,921 | 7/1990 | Mardon et al. | 420/422 |
| 4,981,527 | 1/1991 | Charquet | 148/672 |

FOREIGN PATENT DOCUMENTS

| | | | |
|---|---|---|---|
| 296972 | 12/1988 | European Pat. Off. . | |
| 2302348 | 10/1976 | France . | |
| 2415147 | 8/1979 | France . | |
| 0007027 | 2/1985 | Japan | 148/672 |
| 1537930 | 1/1979 | United Kingdom . | |

*Primary Examiner*—Upendra Roy

*Attorney, Agent, or Firm*—Dennison, Meserole, Pollack & Scheiner

[57] ABSTRACT

Zircaloy 2 or 4 strip is heat treated in the beta range, followed by rapid cooling by passing the strip between a first and second roller pair, each roller pair having two oppositely disposed rollers gripping the strip. Each roller pair is connected to a source of an electric current so as to complete an electric circuit including the source, the roller pairs and the strip, which causes heating of the strip to the beta range. The strip is heated at a rate less than 40° C./sec between 750° and 1000° C., held at 1000°-1100° for less than 2 minutes and cooled at a rate of at least 40° C./sec between 1000° C. and 600° C.

9 Claims, 2 Drawing Sheets

CONTROLLED RESISTIVE HEAT TREATMENT FOR A CONTINUOUSLY MOVING ZIRCALOY SHEET

BACKGROUND OF THE INVENTION

The present invention relates to a method of manufacturing and more particularly of heat treating a strip or sheet of Zircaloy 2 or Zircaloy 4. The compositions of these alloys, Zircaloy 2 and Zircaloy 4, are given in ASTM Specification B 352-85, in which these alloys correspond to grades R60804 and R60802, respectively.

Typically, the cases of fuel assemblies for boiling water nuclear reactors are made of Zircaloy 4 or Zircaloy 2.

Two essential properties that are sought are good behavior in terms of nodular corrosion and low deformation under irradiation. To obtain these results, it is essential that the constituent sheets have an adequate metallurgical structure, including fine second-phase precipitates quite close to one another, and an isotropic crystallographic structure.

Structures originating from various methods have been proposed to obtain the distribution of precipitates desired:

a) alpha-type obtained by production methods which after an intermediate quenching from the beta range include only alpha heat treatments, at limited times and temperatures.

b) (alpha+beta) structures, obtained by rapid heating of a sheet by high-frequency induction followed by a rapid chilling, in accordance with French Patent Document B 2,303,865 (equivalent to British Patent 1,537,930, Swedish Patent 7502865, and Swedish Patent 7511523), or obtained by rapid heating of some part, such as a case or a cladding tube, again by electrical induction, this heating being followed by rapid chilling until the alpha range is reached, as described in French Patent 2,302,569 (equivalent to U.S. Pat. No. 4,238,251). In the second method, provision is made for treatments in the beta range up to 825° and 965° C., but no example is given.

In (alpha+beta) heat treatments, it is necessary for the heating to be rapid (within a few seconds), and the cooling also, for example at least 20° C. per second down to 720° C. The conditions taught are not applicable to very long strips, typically more than 100 m long, with sheets for cases then being cut from such a strip.

Applicants have sought to develop a method that is applicable to strips, for uniformly providing good resistance to nodular corrosion and low deformation under irradiation.

SUMMARY OF THE INVENTION

The present invention is a method for producing a strip or sheet of Zircaloy 2 or 4, including heat treatment operations in the beta range followed by rapid chilling, with operations performed under the following conditions:

a) heating up to the beta range, the heating rate being less than 40° C. per second between 750° and 1000° C.;

b) holding for less than 2 minutes between 1000° and 1100° C.;

c) then, chilling at a rate of at least 40° C. per second between 1000° C. and 600° C.

These operations are accomplished by passing the strip or sheet at a high constant speed between the rollers of at least two successive pairs of rollers, these pairs of rollers being supplied with electrical current and gripping the strip or sheet in such a manner as to form at least one current loop, the strip then passing between means for rapid chilling of both its sides.

Except for the beginning of the passage between the rollers, which is discarded or rejected, a very regular texture and structure are obtained, both crosswise and lengthwise. The Joule-effect heating used in the method is produced in the entire volume, unlike induction heating. Typically, the strips treated are about 240 mm in width and greater than 100 m in length, the strips then being cut into sheets more than 4 m in length.

Applicants have demonstrated that in the case of the beta treatments used in the invention, it is important to perform a rapid quenching or chilling, but contrary to the teaching of French Patent 2,302,569, it is unnecessary to have a rapid rise in temperature.

In the method of the invention, it is suitable to have the strip move rapidly, in order to have rapid quenching. The heating up to the beta range may, on the other hand, be relatively long, for example from 30 seconds to 2 minutes, for a travel speed of one to two meters per minute, unlike a quenching method based on (alpha+beta).

Surprisingly, and advantageously constantly or regularly as indicated, the strips and sheets obtained by the method of the invention are quasi-isotropic and have no or very little preferential deformation under irradiation, i.e. in the reactor Their textures have the following Kearns factors:

$$f_N=0.35 \text{ to } 0.45 - f_T=0.25 \text{ to } 0.35 - f_L=0.25 \text{ to } 0.35$$

in which, by definition, $f_N+f_T+f_L=1$, while the sheets of the alpha or (alpha+beta) type of structure conventionally have a pronounced crosswise tendency in the orientation of base planes (0002), with the following typical Kearns factors:

$$f_N=0.65 - f_T=0.25, \text{ and } f_L=0.10.$$

In addition, the strips or sheets of the invention have good resistance to nodular corrosion; their weight gain in the one-day corrosion test at 500° C. in water vapor under pressure is less than 60 mg/dm$^2$.

The strip or sheets can be driven through pairs of successive rollers, or the strip or sheets can be driven by means of these rollers in the manner of a rolling or calendering operation. The current is preferably connected parallel to the rollers of each pair, and may be alternating current, but is preferably direct current or rectified current to assure better homogeneity of temperature in a cross section of the product.

To regulate heating and holding separately, two series, each having two pairs of successive rollers may be used, each series being supplied with a particular electric current. When the two series are supplied with different currents, the current of the second series is selected to regulate holding of the strip or sheet above 1000° C.

Conventionally, the heating speed obtained between 750° and 1000° C., a range which includes the (alpha+beta) range, is from 10° to 30° C./s, and the holding at temperature ranges from 20 seconds to 1 minute above 1020° C., and preferably below 1070° C.

For employment of the method, before the continuous operations are initiated (as evidenced by passage of the strip or successive sheets at a constant speed), gripping of one end or the beginning of the aforesaid strip or sheet between the pair of rollers is first done without flow of current; then the sheet or strip is driven and current flow is initiated, the already engaged length of the strip or sheet being subsequently discarded.

The strip or sheet is quenched on leaving the beta range shortly after its departure from holding within the range by flow of electric current (the Joule effect). The rapid chilling means, preferably a mist of liquified neutral gas on the top and bottom faces of the strip or sheet, are placed at a reduced distance from the last rollers, so that the temperature of the product at the beginning of the chilling will still be greater than or equal to 980° to 1000° C.

One advantage of this very rapid heat treatment is that despite the elevated temperature attained, superficial oxidation is typically reduced, being at most pale yellow, and is eliminated by the usual pickling that follows. If the oxidation without protection is slightly more pronounced, or if one wishes to reduce the preceding pickling, then at least 80% of the portion of the strip or sheet heated to more than 300° C. is protected on both sides by a neutral gas. Preferably, this gas is argon, helium, or a mixture of argon and helium.

The treatment according to the invention is:

either the final heat treatment of the product;

or a mixed treatment, in which at least two pairs of successive rollers simultaneous with the heat treatment produce a calibration or rolling reducing the thickness by from 1 to 20%;

or an intermediate heat treatment, with manufacture being followed by cycles of cold or warm rolling and heat treatments in the alpha range. Warm rolling is typically under 350° C.

At the stage of the beta heat treatment by the method of the invention, the treated strips or sheets have a thickness typically between 1 and 12 mm. They are intended for example to make sheets for casings or spacer strips.

The invention also relates to a strip or sheet of Zircaloy 2 or 4 that is made by the method, with a fine ex-beta structure in its entire volume, having a quasi-isotropic texture with the following Kearns factors:

$$f_N=0.35 \text{ to } 0.5-f_T=0.25 \text{ to } 0.35 \text{ and } f_L=0.25 \text{ to } 0.35\ (f_N+f_T+f_L=1),$$

and having a weight gain in the one-day corrosion test at 500° C. in water vapor under pressure of less than 60 mg/dm$^2$.

The method of the invention provides a heat treatment with ease of control, which is constant over the entire volume, and perfectly replicable.

The product of the invention has constant nodular corrosion resistance for strips or sheets of the same batch, along with a constant (second phase) structure and a constant texture, and texture causing very little, if any, preferential deformation in the reactor.

DESCRIPTION OF THE PREFERRED EMBODIMENTS

Figure 1:
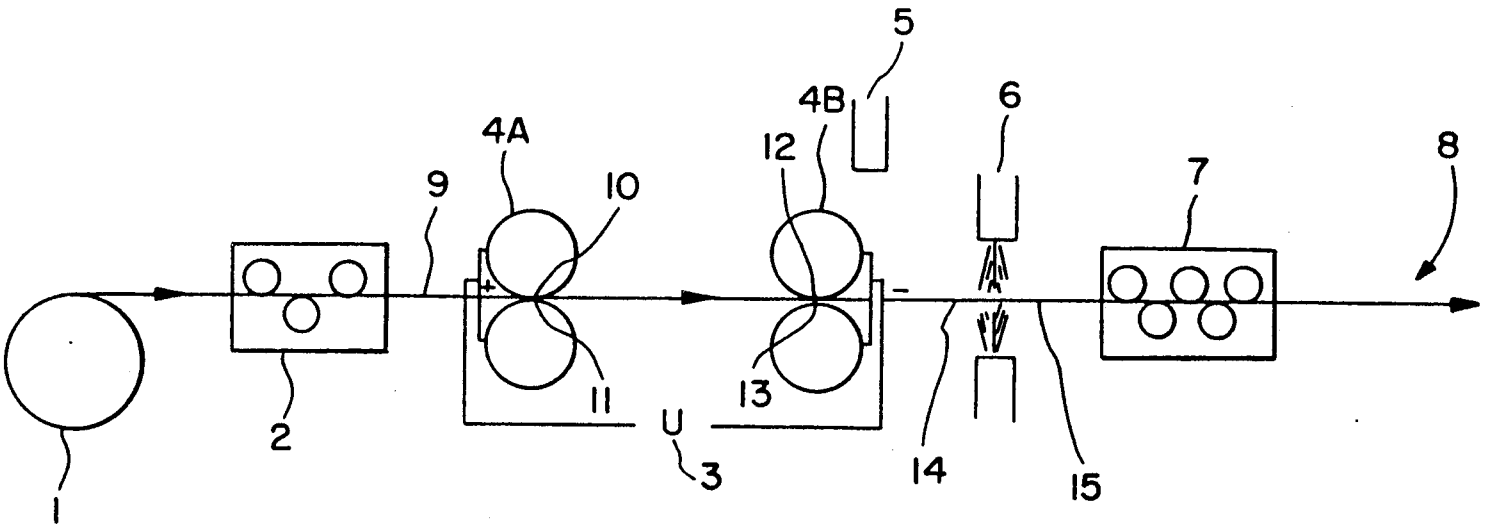
FIG. 1 schematically shows an apparatus for treating a strip or sheet according to the invention, with a strip shown in the course of treatment.

An apparatus as shown in FIG. 1 is used to treat a strip or sheets of Zircaloy 2 or 4 having a thickness of 1 to 3 mm. The apparatus includes a pay-out reel 1 from which the Zircaloy strip is taken and passed to a straightening press 2. The strip is then passed between two roller pairs 4A and 4B, which are connected to a direct current power supply 3, roller pair 4A being connected to the positive terminal and roller pair 4B being connected to the negative terminal. Passage of the current U in the circuit including the roller pairs 4A and 4B, and the strip produces heating in this strip which is measured by pyrometer 5. Roller pairs 4A and 4B may optionally be assisted by motors which are not shown.

After passing between the roller pairs 4A and 4B, the strip is passed to a cooling means 6, preferably spraying a mist of liquified neutral gas. Other quenching apparatus can also be used here, such as a mist of atomized water, cylinders chilled with refrigerated water with chilling by contact, etc. After cooling, the strip is passed to a leveler with rollers 7, and to shears 8.

Strip 9 of Zircaloy 4 being treated is under tension between the two roller pairs 4A and 4B, with contact points 10 and 11 at the first roller pair 4A, and contact points 12 and 13 at the second roller pair 4B. The distance between contacts points 10, 11 and 12, 13, which is the length of heating of the strip 9, is 1.2 m, and the speed of travel of the strip, which is 2.4 mm in thickness and 235 mm in width, is 1.5 m/min. For the current used, measurements have shown that it takes approximately 33 seconds, and a distance of 0.82 m traveled from the contact points 10, 11, for the strip to reach 1000° C., a mean heating speed of about 30° C./sec. The strip remains at between 1000° and 1060° C., for the next 0.68 m, or 27 seconds, until it reaches contact points 12, 13. In this zone, the strip is at between 1020° and 1060° C. for 24 seconds.

After leaving the heating zone at 12, 13, the strip reaches cooling means 6, which sprays a mist of liquid nitrogen on both surfaces of the strip. The cooling means 6 is placed 0.4 m from the heating zone, and the temperature in the cooling zone is lowered from 1060° C. to 1000°-1010° C. at the moment the mists act upon the strip. The chilling obtained is very rapid, and the strip leaves the vicinity 14, 15 of the mists, a wide area of 200 mm, at less than 200° C., the chilling speed being at least 100° C./sec between 1000° and 600° C.

Figure 2:
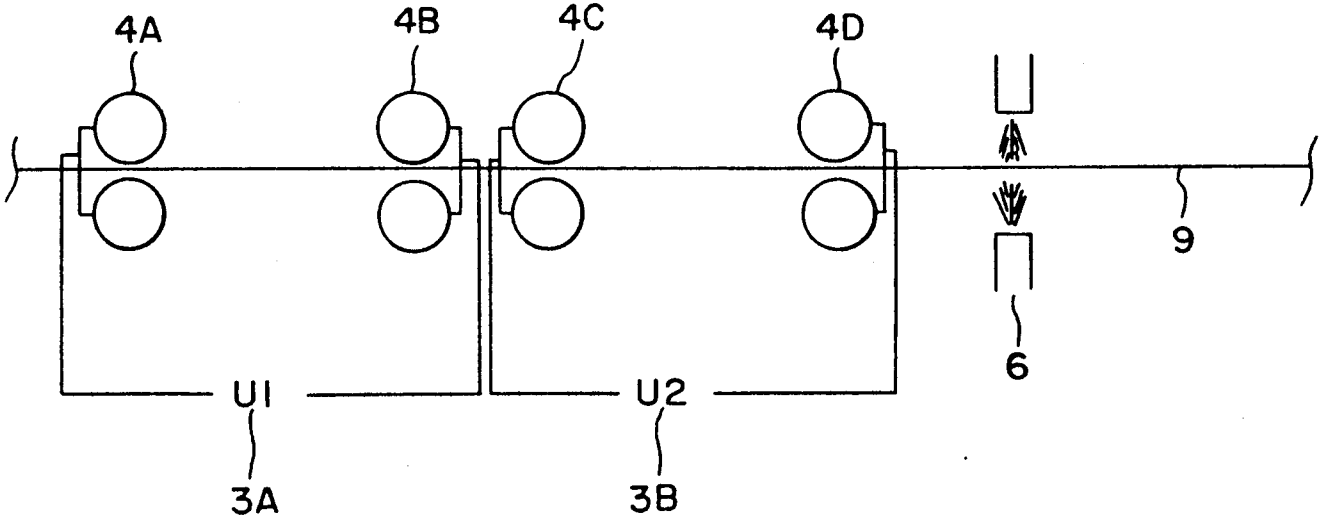
FIG. 2 schematically shows a portion of an alternate apparatus according to the invention, for treating a strip or sheet.

A portion of an alternate apparatus for treating according to the invention is shown in FIG. 2. In FIG. 2, roller pairs 4C and 4D are located after roller pairs 4A and 4B, for treating strip 9. Roller pairs 4A and 4B are connected to a source of current 3A in a first electrical circuit U1, and roller pairs 4C and 4D are connected to a second source of current 3B, to complete a second electrical circuit U2. Electrical circuit U1 serves to heat the strip to the beta range, while circuit U2 serves to maintain the holding temperature of 1000° to 1100° C. Alternately, circuits U1 and U2 can be supplied by the same source of electrical current.

Five samples were taken at various locations of a finished strip, along a length of more than 100 m. The results of tests performed were as follows:

weight gain after one-day corrosion test at 500° C. in water vapor under pressure 43 to 55 mg/dm$^2$;

quasi-isotropic textures with the following Kearns factors, to an accuracy of 0.03:

$f_N=0.4-f_N=0.3$, and $f_L=0.3$.

clear yellow color, easy pickling.

What is claimed is:

1. A method for treating a Zircaloy 2 or Zircaloy 4 strip by heating in the beta range followed by rapid cooling, comprising:

passing the strip at a predetermined velocity between a first and second roller pair, each said roller pair comprising two oppositely disposed rollers gripping the strip;

connecting each of said roller pairs to an electric current source so as to complete an electric circuit including the electric current source, the first and second roller pairs and the strip, said complete circuit and said predetermined velocity operating to heat the strip to the beta range at a rate less than 40° C./sec between 750° and 1000° C.;

passing the strip heated to the beta range between third and fourth roller pairs located between said second roller pair and said cooling, said third and fourth roller pairs connected to a further source of electric current, forming a completed circuit including said strip, said third and fourth roller pairs and said further source of electric current, said third and fourth roller pairs operating to hold the strip at 1000°-1100° C. for less than 2 minutes; and cooling the strip at a rate of at least 40° C./sec between 1000° C. and 600° C.

2. The method of claim 1, wherein the heating rate between 750° and 1000° C. is from 10° to 30° C./sec, and wherein said holding takes 20 seconds to 1 minutes above 1020° C.

3. The method of claim 1, wherein prior to initiating heating an initial length of strip is passed between said first and second roller pairs without connection to a source of electric current.

4. The method of claim 1, wherein at least 80% of said sheet or strip at above 300° C. is protected by a neutral gas.

5. The method of claim 1, wherein said method for treating is a final heat treatment.

6. The method of claim 1, wherein at least two pairs of successive rollers, simultaneous with said method for treating, produce a calibration or rolling, reducing the thickness of the strip by 1 to 20%.

7. The method of claim 1, wherein said method for treating is followed by cold or warm rolling and by heat treatments in the alpha range.

8. A method according to claim 1, wherein said strip is cooled by spraying with a mist of a liquified neutral gas.

9. The method of claim 4, wherein said neutral gas is argon, helium or a mixture of argon and helium.

* * * * *